United States Patent [19]

Anderson et al.

[11] 4,266,108

[45] May 5, 1981

[54] MICROWAVE HEATING DEVICE AND METHOD

[75] Inventors: George R. Anderson, Minneapolis, Minn.; Walter R. Ott, Middlesex; Edward J. Smoke, Edison, both of N.J.; Ross A. Easter, Minneapolis; Jeffrey J. Sholl, New Brighton, both of Minn.

[73] Assignee: The Pillsbury Company, Minneapolis, Minn.

[21] Appl. No.: 24,758

[22] Filed: Mar. 28, 1979

[51] Int. Cl.[3] ..... H05B 6/64

[52] U.S. Cl. ..... 219/10.55 E; 219/10.55 M; 426/243; 426/107; 99/451; 252/62.56

[58] Field of Search ..... 219/10.55 E, 10.55 M, 219/10.55 R; 426/243, 241, 237, 238, 107; 99/451, DIG. 14; 252/62.56, 62.58, 62.6, 62.62; 126/390

[56] References Cited

U.S. PATENT DOCUMENTS

| | | | |
|---|---|---|---|
| 2,830,162 | 4/1958 | Copson et al. | 219/10.55 E X |
| 3,573,207 | 3/1971 | Deschamps | 252/62.58 |
| 3,773,669 | 11/1973 | Yamauchi et al. | 219/10.55 E X |
| 3,941,967 | 3/1976 | Sumi et al. | 219/10.55 E |
| 4,116,906 | 9/1978 | Ishino et al. | 252/62.6 X |

OTHER PUBLICATIONS

Microwave Heating, 2nd edition, Avi Publishing Company, 1975, by D. A. Copson, chapter 12, pp. 286-302.

Agricultural and Food Chemistry, vol. 3, No. 5, May 1955, p. 424, "Browning Methods in Microwave Cooking", by D. A. Copson et al.

*Primary Examiner*—Thomas J. Kozma
*Assistant Examiner*—Philip H. Leung
*Attorney, Agent, or Firm*—Robert J. Lewis; Michael D. Ellwein; Mart C. Matthews

[57] ABSTRACT

A microwave heating device is comprised of a microwave reflective member having positioned adjacent thereto magnetic microwave absorbing material. The absorbing material, by being magnetic, will heat by coupling of the magnetic component of microwave radiation. The thickness of the absorbing material is such that at the Curie temperature the material will reflect at least about 65% of the incident microwave radiation. The absorbing material has a volume resistivity value R, at room temperature, in ohm cm of greater than about the value where Log R=(Tc/100)+2 where Tc is the Curie temperature (°C.) of the material. By the proper combination of thickness, high resistivity and Curie temperature, the device is temperature self-limiting in a microwave field and can be used to heat objects in contact with the device to predetermined temperatures in spite of wide fluctuations in microwave power or power uniformity.

50 Claims, 19 Drawing Figures

MICROWAVE HEATING DEVICE AND METHOD

FIELD OF THE INVENTION

The present invention relates to a heating device for use in a microwave radiation environment to absorb microwave radiation and thereby produce heat. More particularly the present invention relates to a heating device which is adapted for cooking food or heating other substances in heat transfer relation with the device in a microwave radiation environment.

BACKGROUND OF THE INVENTION

The cooking of food and heating of substances with microwave radiation has become increasingly popular and important in recent years because of its speed, economy, low power consumption, etc. With food products, however, microwave heating has drawbacks. One major drawback is the inability to brown or sear the food product to make it similar in taste and appearance to conventionally cooked food. This is a major drawback to consumer acceptance of the food product. Attempts have been made to overcome the browning problem and have achieved varying degrees of success. One method of achieving browning is to coat food with a substance which will brown from continued exposure to microwave radiation and thereby impart a browned appearance and taste to the food product. Such a solution works fairly well with certain types of foods; however, with pastry products, for example, breads, crusts, etc., such a method has not been acceptable. Bread and other pastry products have a tendency to become soggy after a short cooking period in a microwave oven thereby preventing crisping of the exterior of the bread product to simulate conventionally cooked pastry products. Sogginess is even more pronounced when the bread product is used in combination with a topping or other food product having high moisture. The moisture from the additional food product migrates to the bread product further magnifying the sogginess problem. Continued cooking of the food products will not solve the problem because the total food product would be too dry for consumer acceptance.

One means of overcoming the above problems has been to provide utensils which will heat in a microwave environment. Food product adjacent to the heated surface of the utensil will sufficiently dehydrate to provide the desired crisping or browning effect which is so desirable to consumers. Many utensils are available on the market to achieve such browning, however, they are costly, take a significant period of time to heat to operating temperatures, and they can heat to unlimited temperatures (practically) creating a safety problem. Therefore, the utensils are not adapted for use with machine-vended food products or ready-to-prepare food products from the supermarket.

Numerous browning utensils are known in the art of which the apparatus disclosed in U.S. Pat. No. 3,941,967 to Sumi et al is an example. Another type of browning apparatus is generally referred to as a browning dish as, for example, those made by Corning Glass Co. Although these devices are somewhat effective in operation, there is no practical limit to the temperature to which they will heat; that is, they will exhibit thermal "runaway". Many materials which when subjected to microwave radiation will continue to heat without any practical temperature limit being obtainable, thermal runaway. This is generally due to the dielectric property of the absorbing material or lossy material. As the temperature of the absorbing material increases, the resistance decreases thereby allowing the absorbing material to heat under the influence of the electric field portion of the microwave radiation. This, to date, has not been such a serious problem from a practical standpoint because the cooking utensils have had a substantial head load, i.e., the utensil material and the food or product to be heated, which will absorb the heat from the absorbing material at a rate sufficient to prevent the absorbing material from becoming overheated. However, with the requirement of a heat load, utensils have not been as versatile as they could be because they would have to be designed for an average heat load. This means that a heavy heat load would not cook as fast as intended and a light heat load would cook too fast or burn.

Certain microwave absorbing materials, specifically ferrites, have a Curie temperature which is readily measureable as, for example, *TGA Measurement of the Curie Temperature of Commercial Ferrites* by R. Ott and M. G. McLaren; published in "In the Proceedings of the International Conference on Thermal Analysis II", 1968, Vol. 2, pages 1439–1451, Academic Press, New York, copyright 1969. Absorbing materials which exhibit Curie temperature properties should theoretically have an upper temperature limit, of about the Curie temperature, which can be attained when subjected to microwave radiation. This is discussed in U.S. Pat. No. 2,830,162 to Copson. However, there is no teaching of how self-limiting temperature can be achieved, just that it should be achievable. Self-limiting or lack of it is best understood by a study of FIG. 16 which shows that without a reflective plate, temperature limiting was not achieved. The problem was presented of how to provide a heating device which will have an upper temperature limit for operation such that the problems encountered with currently-used browning devices can be overcome. Further, if an upper temperature limit can be achieved and pre-determined, cooking of various types of foods can be simplified and accomplished with greater precision than can be obtained with the typical non-temperature limiting browning dish.

An object of the present invention is to provide a device which will heat under the influence of the microwave radiation up to an upper temperature limit at which temperatures the device ceases substantially to absorb microwave energy and heat to a higher temperature. Another object of the present invention is to provide a heating device which is disposable and adapted for use with pre-prepared foods. A still further object of the present invention is to provide a heating device which can be utilized as a non-disposable utensil. A still further object of the present invention is to provide a heating device which by appropriate selection of manufacturing parameters can provide a predetermined upper temperature limit. Another object of the present invention is to provide a heating device which is inexpensive to manufacture, safe to use and well adapted for its intended use.

Other objects and advantages of the present invention will become apparent from the following detailed description taken in connection with accompanying drawings wherein are set forth by way of illustration and example certain embodiments of this invention.

DESCRIPTION OF THE INVENTION

Figure 1:
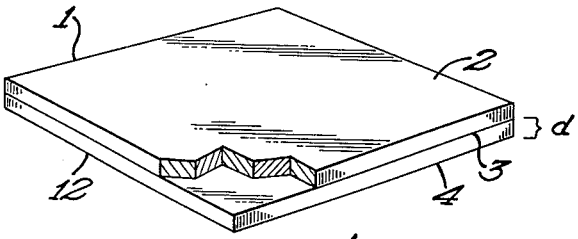
FIG. 1 is a perspective view of a heating device with a section thereof broken away to show structural details of the device.

The present invention provides a heating device which exhibits an upper temperature limit for operation without requiring a heat load to remove heat as in prior microwave energized heating devices. It has been found that by selecting an appropriate material as the absorber, for example, ferrites having a Curie temperature, which is preferably in the range of between about 0° C. and 500° C. and more preferably for cooking in the range of between about 100° C. and 400° C. and that by selection of other properties, discussed below, of the absorbing material, an upper temperature limit can be reliably obtained. It is theorized that the upper temperature limit will be the Curie temperature, but because of heat loss to the microwave reflective plate and the environment, the limiting temperature will be slightly less than the Curie temperature, depending upon the heat load. Through experimentation it has been found that temperature limiting can be achieved by selecting an appropriate DC volume resistivity for the material, as measured at room temperature, and by selecting the thickness of the material within a prescribed range and by having the material adjacent to a metallic reflective member. Also, by control of the composition of the material, the upper temperature limit can be pre-determined such that one can provide a heating element which will, for example, operate at a limiting temperature of 200° C. and another heater which will temperature limit at 250° C., etc., and not require a heat load to limit temperature. Thus, the versatility of the present invention is readily apparent.

Although not wishing to be bound by the following theoretical explanation of the operation of the present invention, the following explanation is provided.

Generally, ferrite materials exhibit both magnetic permeability and dielectric permitivity in which heating of the absorbing material by microwave radiation absorption can be accomplished both by the magnetic field component of the microwave radiation and the electrical field component of the microwave radiation. Because the resistance of a material decreases as temperature increases, dielectric heating becomes more of a factor in heating and can cause thermal runaway because resistance heating occurs. Therefore, the problem was to provide a device which would utilize the magnetic field component as the source of energy for heating while substantially excluding the electrical field component from providing energy for heating to prevent thermal runaway. By appropriately choosing a sufficiently high resistance to prevent the absorbing material from becoming a semiconductor during heating and by selecting an appropriate material thickness, heating of the material by the electric field component is virtually eliminated.

Microwave radiation is composed of at least two components, one of which is an electric field and another one is a magnetic field, oscillating in time and propagating through space. When microwave radiation is reflected from a metallic boundary, the electric wave and the magnetic wave are out of phase by 90° and are said to be of a standing wave type; that is, they cease to propagate. At the reflective surface, the magnetic amplitude wave is maximum while the electric wave node is at the reflective surface. This phenomna is an inherent characteristic of microwave radiation when it impinges on a metallic reflective surface due to the properties of the metal. For a detailed discussion of this phenomenon, see "Dielectrics and Waves," by A. R. Von Hippell, MIT Press (1954).

From the above discussion, it can be seen that by holding the thickness within at least one critical thickness range that the peak of the magnetic component wave will be within the confines of the absorbing material while the node of the electric field component will be within the confines of the absorbing material. Because the electric field node is within the confines of the material, little or no energy is available to the absorbing material from the electric field component. Further, by using a material with high resistance, the high resistance will substantially prevent resistance heating of the material due to the minor amount of exposure of the absorbing material to the electric field component of the microwave radiation.

Absorbing materials include materials having ferromagnetic or ferrimagnetic properties, a Curie temperature and an ability to heat when exposed or subjected to microwave radiation. Such materials include magnetic oxide materials that are known as ferrites and that belong to one of three crystallographic classes: garnets, spinels and hexagonal ferrites. The preferred materials are spinels such as Ni $O.Fe_2O_3$ and hexagonal ferrites such as $BaO.6Fe_2O_3$, crystalline or polycrystalline, pure or as part of a mixture that is prepared as single or multiple ceramic piece. The more preferred materials are the hexagonal ferrites, as above, containing substantial portions of $Fe_2O_3$, BaO and one or more other divalent metal oxides, such as BaO. MgO. $3Fe_2O_3$.

Figure 5:
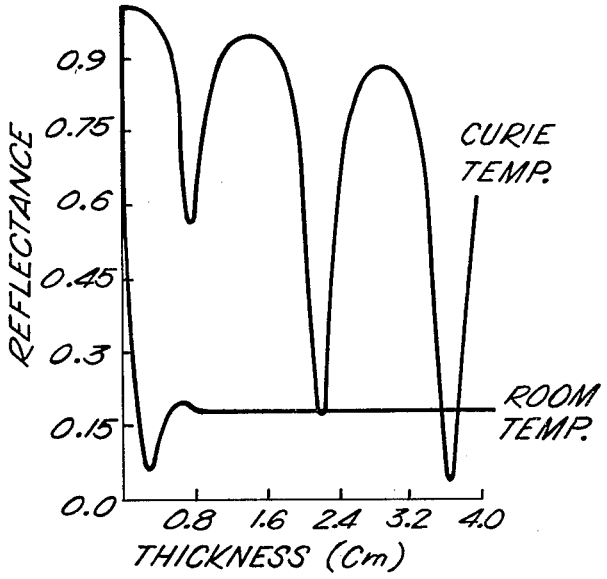
FIG. 5 is a graph illustrating the functional relationship between reflectance and absorbing material thickness at both room temperature and Curie temperature.
Figure 6:
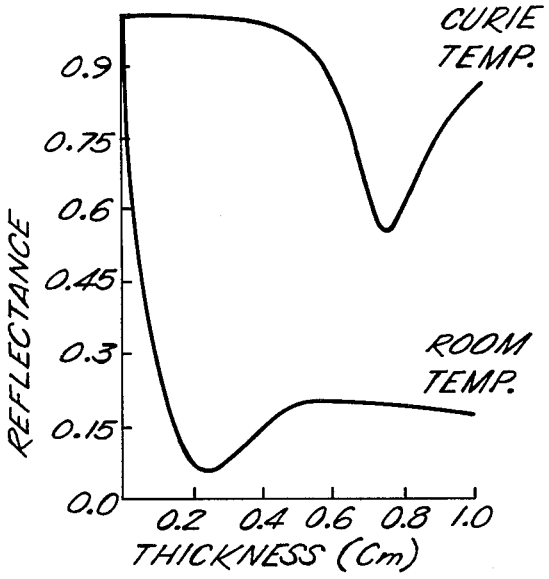
FIG. 6 is an enlarged portion of the graph of FIG. 5.

FIGS. 5 and 6 illustrate calculated functional relationships between power reflectance and material thickness. Calculations were based on equations and considerations disclosed in *Revised Modern Physics,* Vol. 29, page 279 (1957) by Miles, Westphal and Von Hippell. The material was considered to be $Mg_2Y$ ($Mg_2Ba_2Fe_{12}O_{22}$) having the following values at 2450 MHZ:

| Room Temperature | Above Tc (255° C.) |
|---|---|
| $\epsilon'$ 17.58 | 17.58 |
| $\epsilon''$ 0.76 | 0.76 |
| $\mu'$ 1.38 | 1.00 |
| $\mu''$ 5.84 | 0.00 |

These graphs illustrate that it is theoretically possible to have more than one thickness range of material which will produce self limiting heaters.

Two samples of $Mg_2Y$ were tested and had a thickness of 7.7 mm and 9.3 mm, which by theory, the 9.3 mm sample should have self limited, but did not. However, this can readily be accounted for in that the above values and other assumptions on which the equations were based may not have applied to this particular sample. These values and assumptions if different than the sample would change the curve by making the peaks higher or lower and closer together or further apart, but not the general shape of the multiple peak Curie temperature curve. Also, from FIG. 5, it can be seen that a 9.3 mm sample is on the borderline of the above 65% reflectance value above which value it is believed that the present invention is operable.

As can be seen from FIGS. 5, 6, 7, 8 and 10, the selection of the thickness of the material is of importance in achieving self-limiting. The thickness (d) of the material is measured generally normal to the reflective member. In the broadest use of the term thickness (d) herein and in appended claims, it will be defined as the spacing from the outer or exposed surface 12 of the material to the reflective surface 3 of the plate 1 which would include the thickness of any material interposed between the plate 1 and material 4. The thickness of the material is more aptly expressed as being that thickness which will preferably provide at least about 65%, more preferably at least about 75% and most preferably at least about 90% reflectance of microwave energy when the microwave absorbing material is at its Curie temperature. A most preferable thickness is expressed by the ratio of thickness (d) to wave length ($\lambda$) of the microwave radiation in the material to which the material is subjected at the Curie temperature of the material. By this manner of expression $d/\lambda$ at all microwave frequencies is preferably less than about 0.25, more preferably less than about 0.16 and most preferably between about 0.02 and about 0.16. This is best seen pictorally illustrated in FIG. 7. In FIG. 5 the line indicating the functional relationship between reflectance and thickness for the absorbing material at room temperature indicates that the microwave absorbing material may be too thin as well as too thick to achieve optimum heating. If too thin, the heating rate will be substantially reduced because the magnetic component will not provide as much energy for absorption because of the high amount of reflectance. If too thick, then the electric field component will be absorbed providing for potential thermal runaway. However, the material can be utilized in the reduced thicknesses and still be operable to prevent thermal runaway. This is the reason for the most preferred range of $d/\lambda$ being between about 0.02 and about 0.16.

$\lambda$ will vary with the frequency of the microwave energy to which the microwave absorbing material is to be exposed. Currently, the microwave spectrum is considered to be in the range of between about 300 MHZ and about $10^5$ MHZ and the invention is operable in this range. Once a frequency has been selected for use, $\lambda$ can be determined in a given material with $\lambda$ being the wavelength in the material at Curie temperature. Currently, the FCC has established four frequencies for use within the microwave range with these frequencies being about 915 megahertz, about 2450 megahertz, about 5800 megahertz and about 22,125 megahertz.

At 915 megahertz, the material thickness for $Mg_2Y$ or other material having similar $\epsilon'$, $\epsilon''$, $\mu'$, and $\mu''$ values will preferably be less than about 19.5 millimeters, more preferably less than about 12.5 millimeters and most perferably between about 12.5 millimeters and 1.6 millimeters. At 2450 megahertz the material thickness will preferably be less than about 7.3 millimeters, more preferably less than about 4.7 millimeters and most preferably between about 4.7 millimeters and 0.6 millimeters. At 5800 megahertz, the material thickness will preferably be less than about 2.7 millimeters, more preferably less than about 1.7 millimeters and most preferably between about 1.7 millimeters and 0.2 millimeters. At 22,125 megahertz, the material thickness will preferably be less than about 0.81 millimeters, more preferably less than about 0.52 millimeters and most preferably between about 0.52 millimeters and 0.06 millimeters.

The minimum width dimension (diameter) to thickness ratio is an important factor to consider and should be at least 1:1. Preferably, the ratio is 3:1, more preferably 6:1, and most preferably 10:1 to limit the amount of radiation impinging on the side of the material in a direction generally parallel to the reflective member. This is important so that the majority of microwave radiation penetrating the material will reflect from the reflective member and form the standing wave.

Currently, most microwave ovens are designed to operate at about 2450 megahertz, with this being the currently preferred embodiment of the present invention for the cooking of foods.

Figure 7:
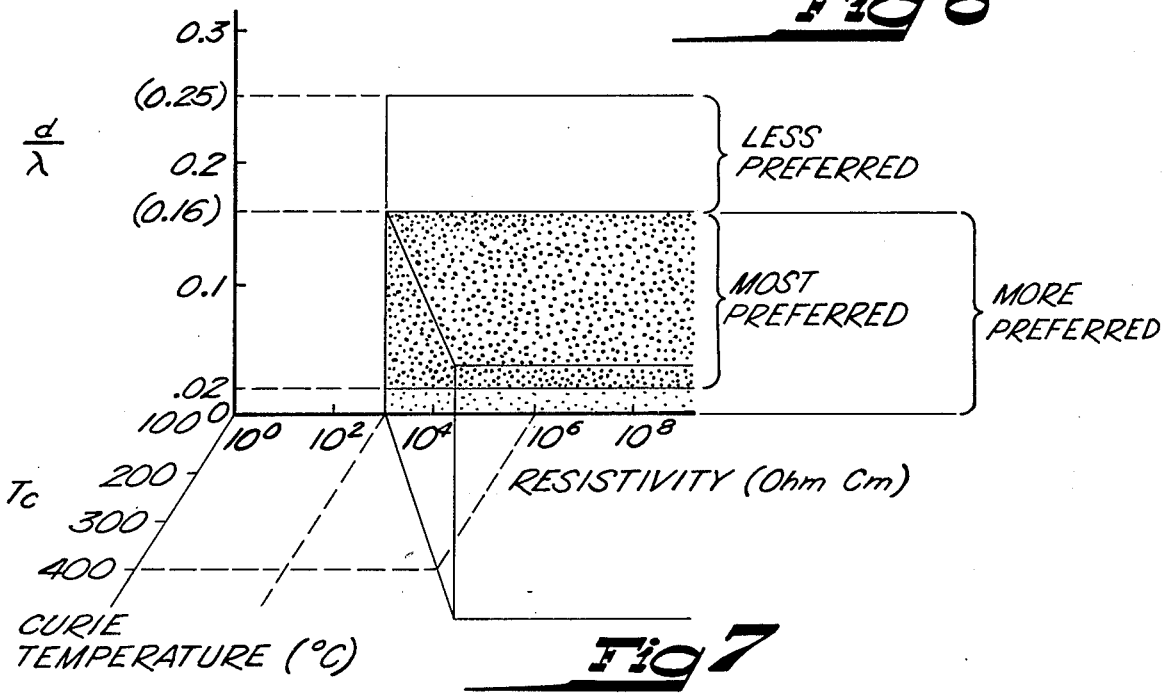
FIG. 7 is a three-dimensional graph illustrating the preferred area from which values for the invention can be selected.

It can be seen from FIG. 7 that the higher the Curie temperature the higher the resistance of the material should be to achieve self-limiting. Resistance will be referred to as the DC volume resistance or that measured at a frequency of 1000 Hertz (since resistance is independent of frequency in this range of the material) with the material being at room temperature as, for example when measured in accordance with ASTM test D 150-68 test. Generally, the resistance of the material is higher than about the value of resistance determined by the equation Log R=(Tc/100)+2 where R=resistance measured at room temperature in ohm cm and Tc=Curie temperature in °C. This defines a line which crosses between the coordinates Tc=100° C. when $R=10^2$ ohm cm and also at Tc=400° C. and $R=10^6$ ohm cm. Preferably, the equation would be Log R=(Tc/100)+2.25, more preferably Log R=(Tc/100)+2.5, and most preferably Log R=(Tc/100)+3.

Referring more in detail to the drawings.

Figure 3:
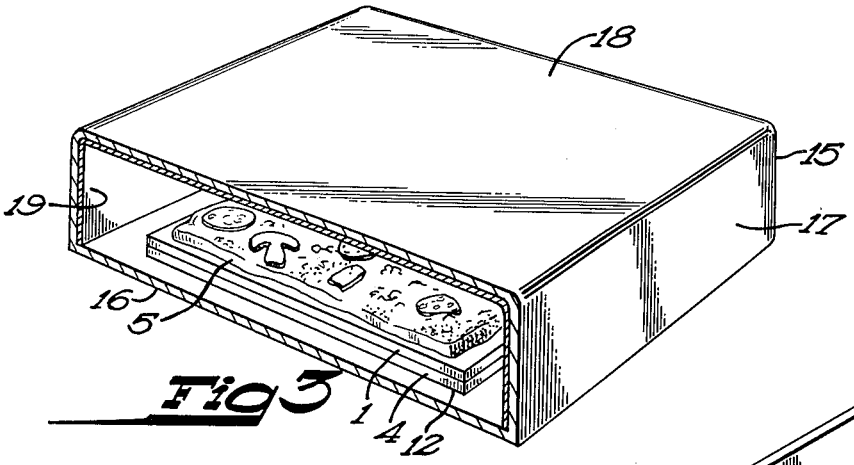
FIG. 3 is an elevational section view of a heating device in a package.

FIG. 1 illustrates one form of the present invention in which a microwave reflective member 1 such as a metal plate for example, aluminum, has two generally planar surfaces 2 and 3. The plate 1 can be of any suitable material so long as it is microwave reflective and is operable to transform the traveling wave into a standing wave. It is to be understood though that the surfaces 2 and 3 can assume various shapes and contours such as slightly curved, round, etc. The plate 1 is in heat transfer relationship to the microwave absorbing material 4 which as shown is in sheet form and as illustrated is positioned adjacent to and secured to the surface 3 of the plate 1. The surface 2 is adapted for being in supporting engagement with a food product 5 or other substance to be heated as seen in FIG. 3. The food product 5 can be in direct contact with the surface 2 or in any other positional relationship so long as there is heat transfer relationship between the surface 2 and the food product 5.

Figure 2:
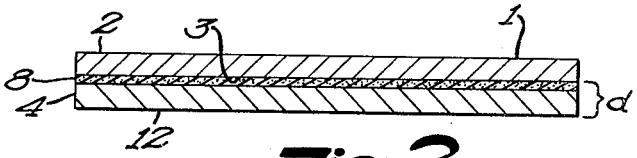
FIG. 2 is an elevational section view of an alternative embodiment of the heating device of FIG. 1.

FIG. 2 shows a second embodiment of the present invention which is similar to the form shown in FIG. 1 with the exception of the heating device 7 including a layer of material 8 sandwiched between the plate 2 and absorbing material 4. In other words, the absorbing material 4 need not touch the reflective member 1 but can be spaced therefrom. Preferably this spacing is such that the distance from the exposed face of the material 4 to the surface 3 has a value calculated by adding the di/λ value for each material with the summation being d/λ and less than about 0.25, more preferably less than about 0.16, and most preferably in the range of between about 0.02 and about 0.16. In other words, $$\frac{d}{2} = \sum_{1}^{i} \frac{di}{\lambda_i}\ ;\ \leqq 0.25 \text{ or } \leqq 0.16$$

or is between about 0.02 and about 0.16. This gap can contain material 8 or can be an air gap or the like. The allowance of space between material 4 and plate 1 is of particular importance when the material 4 is adhered to the reflective member 1 as, for example, with an adhesive or other bonding agent. Also, the material 8 can be a thermal insulator or can provide other properties. The material 8 can be a mixture or a dispersion of grains within a cement matrix to thereby secure the material 8 to the plate 2 in the absorbing material 4 to the layer 8. The material 8 can also be combined with binders, etc., as is known to those skilled in ceramics to form a ceramic material which exhibits ceramic properties both in processing and use.

Figure 9:
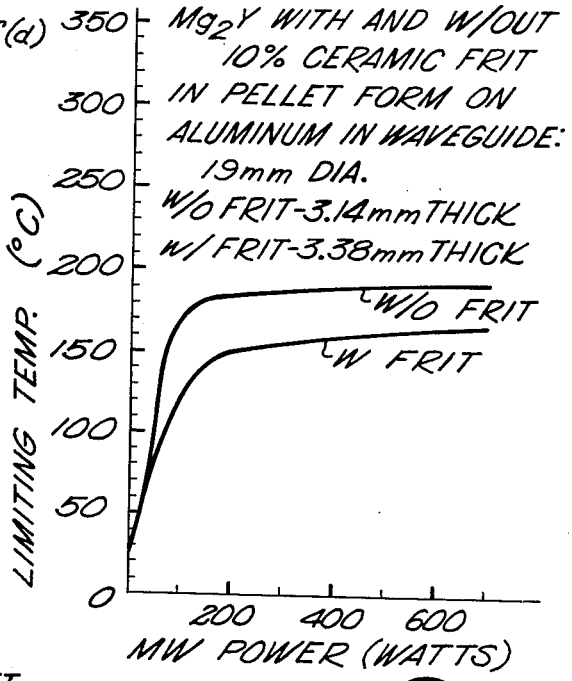
FIG. 9 is a graph illustrating functional relationships between material temperature and microwave power for a material with and without a behavior modifying agent.

The microwave absorbing material can be modified with various agents as, for example, frit, which can be used as a Curie temperature modifying agent to vary the limiting temperature of the material 4. As can be seen in FIG. 9, the addition of 10% by weight frit lowered the limiting temperature approximately 40° C. This reduction in temperature corresponds substantially to the lowering of the Curie temperature which between the two samples was lowered about 30° C. Other temperature modifying agents, for example, chemical substitution agents such as Zn for Mg in $Mg_2Y$ can also be used to adjust the Curie temperature.

Figure 17:
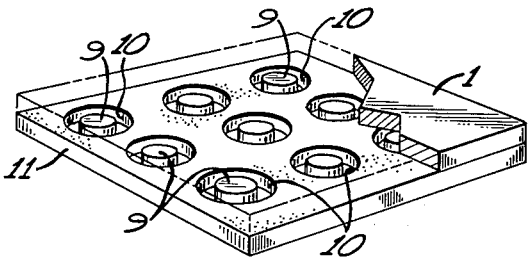
FIG. 17 is a fragmentary view perspective view of a modified form of the invention.

FIG. 17 shows another embodiment of the present invention in which the absorbing material is in the form of a plurality of pellets 9 which are received in respective receptacles 10 in a holder plate 11. The reflective plate 1 is in overlying relation to the plate 11 and can be secured thereto in any suitable manner or can simply rest on top of the plate 11 and be confined in overlying relation by an accompanying package or can be bound thereto. The plate 11 can be of any suitable material and preferably has thermal insulating properties to reduce heat loss to the atmosphere and away from the plate 1. It is to be noted that the forms of the invention in FIGS. 1 and 2 can also be provided with a layer of insulating material on the exposed main planar surface 12 of the absorbing material 4.

It is to be noted that the pellets 9 can be secured directly to the plate 1 with the use of an adhesive such as epoxy, enamel or the like with the back or exposed sides of the pellets 9 being preferably coated with an insulating material to reduce heat loss to the environment.

If an adhesive is used to secure the absorbing material 4 or the pellets 9 to the plate 1 and likewise for the layer 8, it is preferred that the thickness of said adhesive or layer 8 be such that the distance from the exposed face 12 of the material 4 to the surface 3 has a value calculated by adding the di/λ; for each material with the summation being d/λ which is preferably less than about 0.25, more preferably less than about 0.16, and most preferably in the range of between about 0.02 and about 0.16. In other words, $$\frac{d}{\lambda} = \sum_{1}^{i} \frac{d_i}{\lambda_i}\ ;\ \leqq 0.25 \text{ or } \leqq 0.16$$

or is between about 0.02 and about 0.16.

Another form of the invention can include a multi-layered tablet, or material 4, in which different layers of different microwave absorbing materials can be utilized. Also, layers of other materials than microwave absorbing materials can also be utilized in a multi-layered tablet. In the event a multi-layered tablet is used, the value d/λ as used above and in the claims, would be equal to $$\sum_{1}^{i} \frac{d_i}{\lambda_i},$$

In still another embodiment of the present invention, the material 4 need not be of a substantially uniform thickness across the body, but can have a uniform thickness to provide zone heating as is evidenced from the relationship of reflectance to thickness seen in FIGS. 5 and 6. To also achieve zone heating, the material 4 can be separate and distinct pieces positioned adjacent to one another or in contact with one another on the reflective member 1 with certain of the pellets having a different Curie temperature than either of the pellets. This provides an advantage if a dinner, like a frozen dinner, is to be cooked with each separate food requiring a different cooking temperature. This can readily be accomplished by the use of pellets having different limiting temperatures located at various positions on the reflective member 1.

FIG. 3 illustrates a container for use in a microwave oven which can be utilized for packaging the food and heating device for sale to consumers and display in a supermarket. With the cooking of certain foods, it is desirable to heat the food from one side by use of the heating device while at the same time heating the food by exposing it to microwave radiation through the walls of the package 15. As is known in the art, a six-sided package can be provided with the wall 16 being adapted for supporting engagement of the heater and food product 5. To allow microwave radiation to reach the absorbing material 4 or pellets 9, the bottom wall 16 is microwave transparent or opaque at least to the extent that sufficient microwave energy can enter the package to heat the absorbing material 4 or pellets 9 and thereby heat plate 1. The side walls 17 can be shielded as can the top wall 18 thereby restricting the entry of microwave radiation through these walls to the food product as is known in the art. The shielding 19 can be of any suitable type material of which aluminum foil is a currently preferred material. With the use of shielding, the microwave radiation penetrates the microwave transparent or opaque bottom 16 only, therefore not impinging on the food product 5. Accordingly, cooking of the food product 5 in this example is accomplished substantially totally by the heat transferred to the food product 5 from the plate 1. It is pointed out that the terms microwave transparent, opaque and microwave shield are relative terms as used herein and in the appended claims.

Other types of containers can be utilized with the heater of the present invention. The heater of the present invention can also be utilized in non-disposable utensils adapted for repetitive heating cycles by embedding the heater or otherwise associating the heater with a non-disposable utensil body, for example, that disclosed by Sumi et al. The heater is associated with the remainder of the utensil in a manner such that the heater will be in heat transfer relation to a product to be heated in or on the utensil. The utensil can be in the form of an open top dish, griddle or the like.

The above discussion relates primarily to the use of the heating device in a disposable package. However, it is to be understood that the present invention can be utilized in a non-disposable utensil by embedding or otherwise attaching the reflective member 1 and microwave absorbing material 4 within a body 22 of glass or ceramic material. The utensil material could be substantially transparent to microwave radiation, particularly on the bottom side of the dish which would allow transmission of the microwave energy to the material 4 for absorbance thereby. The dish can also include a lid 23 as is known in the art and the lid can be microwave transparent, opaque or shielding, depending upon the type of food desired to be cooked. The dish could also have the metal reflecting member 1 exposed to the inside of the dish for direct contact with the food to be cooked.

Figure 4:
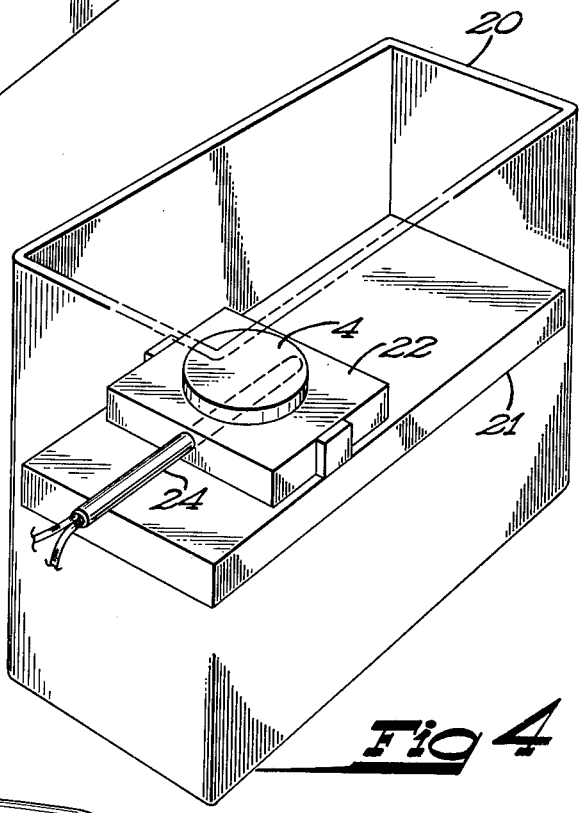
FIG. 4 is fragmentary section view of test apparatus used in producing data for the graphs and examples.
Figure 18:
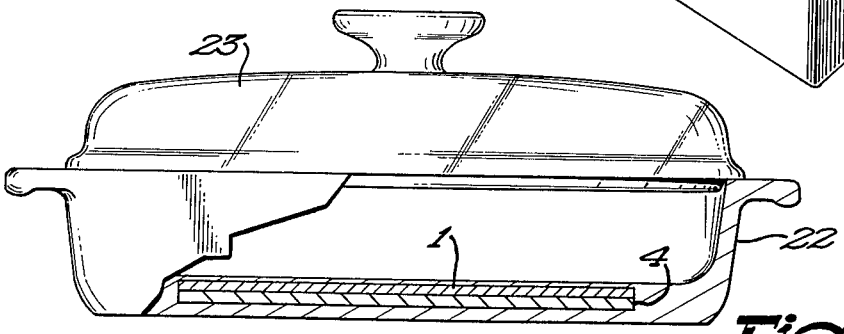
FIG. 18 is an elevational section view of a non-disposable utensil form of the invention.

The operability of the present invention is illustrated by certain of the graphs which are discussed hereinbelow. The experimental work was performed with an apparatus similar to that shown in FIG. 4 in which 20 is an S-band waveguide terminated by a matched water load (not shown) having a microwave transparent block 21 positioned therein. The sample to be tested is positioned on top of a metallic reflective member 22. A shielded thermocouple 24 is positioned in the member 22 and will measure the temperature of the member 22 adjacent the sample to be tested to provide the temperature readout as shown on the graphs. As shown, microwave power is directed from top to bottom from a source made by Gerling-Moore, Inc., having a power rating of 0 to 2500 watts and operates at a frequency of 2450 MHZ.

Due to the limited microwave power density of typical heating applications (i.e., 650 watts in an oven cavity of about 40 liters) the waveguide tests were constrained to the lower power range of 0 to 700 watts. Although it is difficult to estimate, it is believed that applying 700 watts in the waveguide tests would be the equivalent of a typical home-use oven of 1400 watts to 2100 watts (which don't exist).

Figure 8:
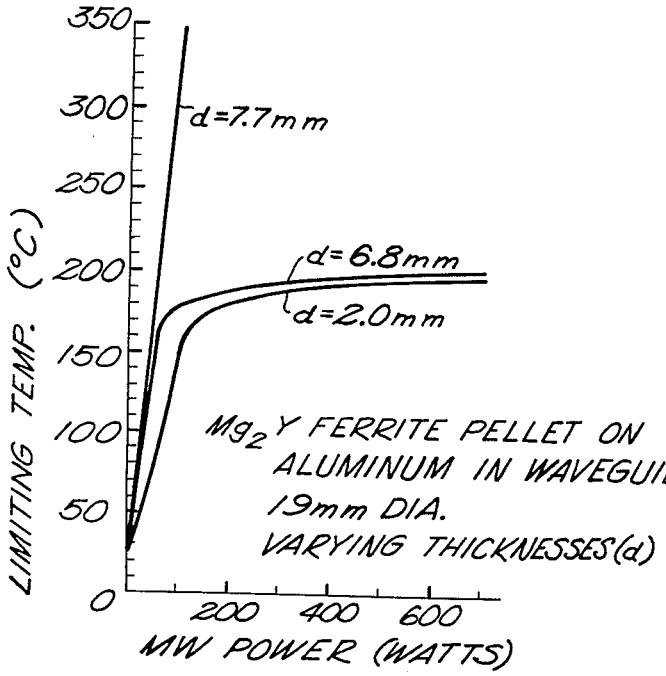
FIG. 8 is a graph illustrating functional relationships between material temperature and microwave power for various thicknesses of material.

FIG. 8 shows a functional relationship of temperature to applied power using $Mg_2Y$ as the material to be tested. $Mg_2Y$ is a shorthand notation for a magnesium ferrite which is $Mg_2\ Ba_2\ Fe_{12}\ O_{22}$. Room temperature dielectric constants were determined using a 0.193 cm thick $Mg_2Y$ sample and a General Radio 900-LB Precision Slotted Line dielectrometer operating at 2450 MHZ. The $Mg_2Y$ sample had a $\mu'$ value of 1.38 a $\mu''$ value of 5.84, an $\epsilon'$ value of 17.58 and an $\epsilon''$ value of 0.76 all measured at room temperature. The resistance of the material is $10^9$ ohm cm at room temperature and $\lambda$ at the Curie temperature (255° C.) is equal to 29.2 millimeters. It can be seen that going from a thickness of 2 millimeters to 6.8 millimeters showing limiting temperatures of about 200° C. However, by increasing the thickness from 6.8 millimeters to 7.7 millimeters, thermal runaway was achieved at a very low power output.

FIG. 9 shows a functional relationship between temperature and power for two types of $Mg_2Y$ materials, one being $Mg_2Y$ and the other sample containing the same $Mg_2Y$ plus 10% ceramic frit. Both materials showed a limiting temperature, although separated by about 40° C. because of the lowering of the Curie temperature by about 30° C. with the addition of the frit to the $Mg_2Y$.

Figure 10:
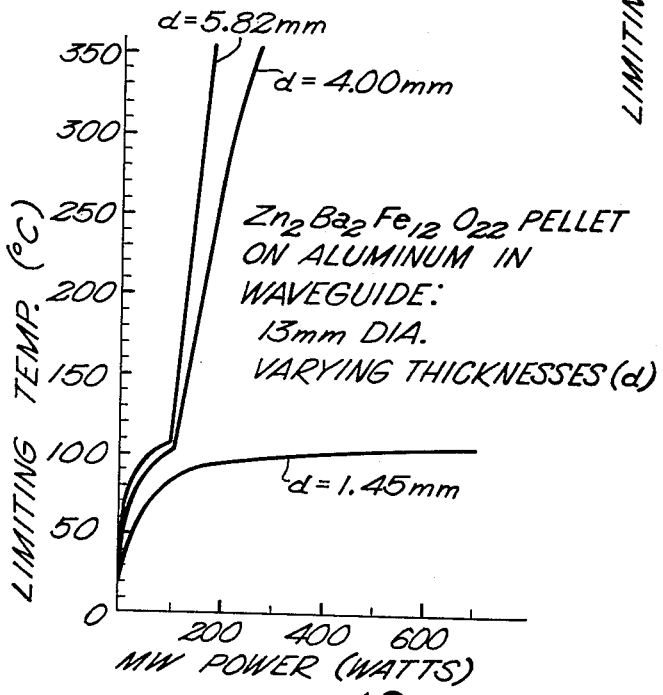
FIG. 10 is a graph illustrating functional relationships between material temperature and microwave power for one material at different thicknesses.

FIG. 10 shows a functional relationship between temperature and power with the material being a zinc ferrite of the formula $Zn_2\ Ba_2\ Fe_{12}\ O_{22}$. It can be seen that at the reduced thickness of 1.45 millimeters, a limiting temperature of about 110° C. was achieved. However, at a thickness of 4 millimeters and 5.82 millimeters, thermal runaway occurred. It is interesting to note that up to the point that 100 watts of power was applied, the curves for the 4 millimeter sample and the 5.82 millimeter sample indicated that an upper temperature limit might be reached. However, at this point there was a sharp rise in temperature indicating what is believed to be a change in the mechanism of heating the sample which is believed to be the electric field component heating causing thermal runaway.

Figure 11:
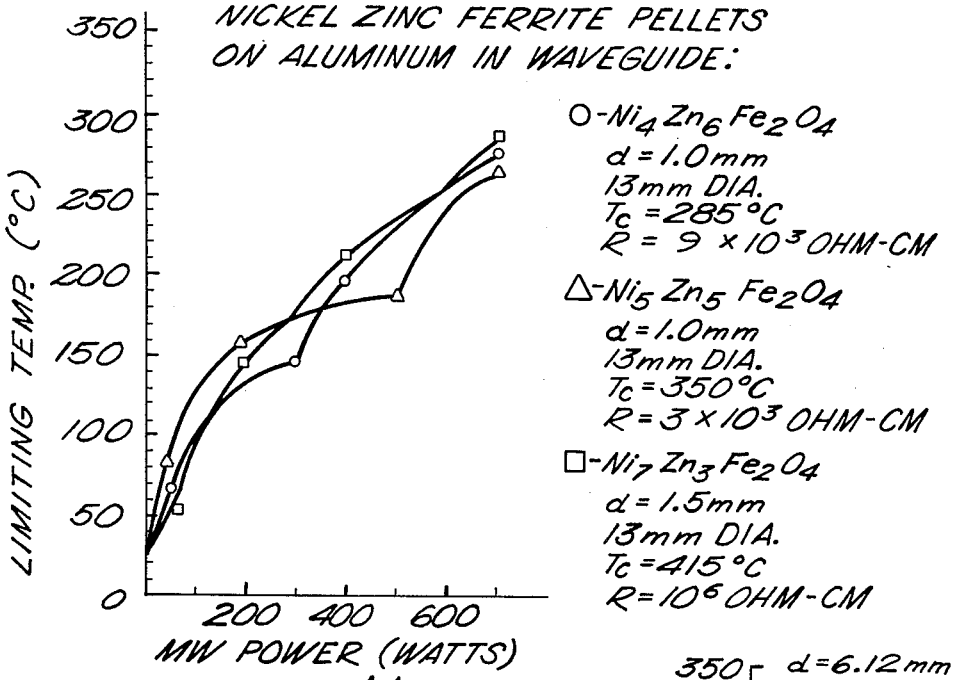
FIG. 11 is a graph illustrating functional relationships between material temperature and microwave power for nickle zinc ferrite having three different compositions and physical properties.

FIG. 11 shows functional relationships between temperature and power for three different types of nickel zinc ferrite. All showed thermal runaway with the same discontinuity in the curves as discussed for FIG. 10 being evidenced on two of the samples of nickel zinc ferrite.

Figure 12:
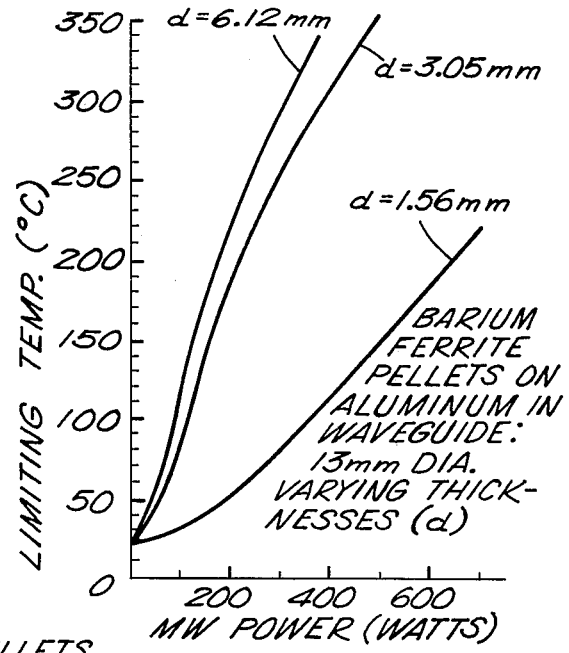
FIG. 12 is a graph illustrating functional relationships between material temperature and microwave power for one material having different thicknesses.

FIG. 12 shows a functional relationship between temperature and power for barium ferrite samples of different thicknesses having a resistance of about $10^4$–$10^5$ ohm cm and a Curie temperature of 465° C. In the Sumi et al patent discussed above, example 2 used barium ferrite having a resistance of $10^2$ ohm cm and a thickness of 2 mm. Because the samples used to prepare FIG. 12 had a higher resistance than $10^2$ ohm cm and thicknesses greater than and less than 2 mm, it is unlikely that Sumi et al achieved self limiting.

Figure 13:
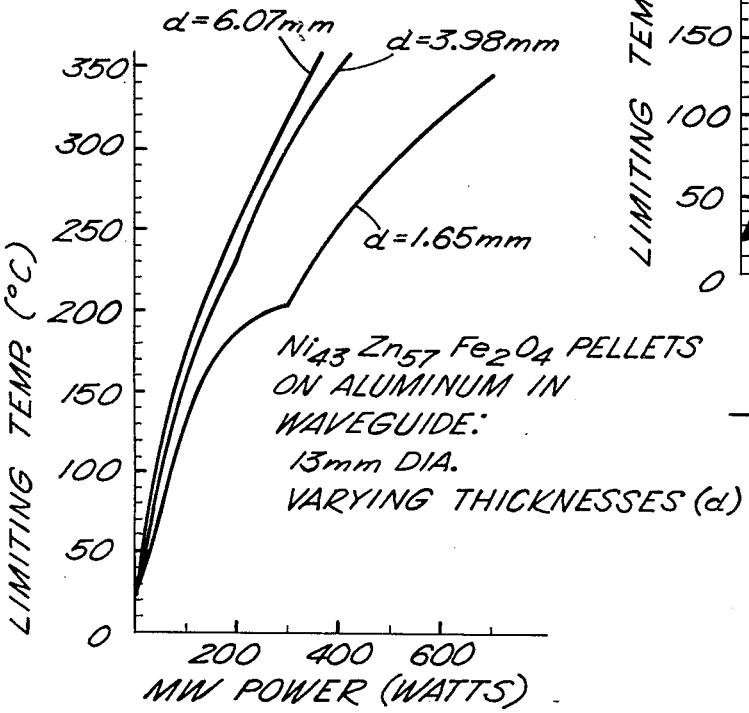
FIG. 13 is a graph illustrating functional relationships between material temperature and microwave power for one material at different thicknesses.

FIG. 13 shows functional relationships between temperature and power for three samples of nickel zinc ferrite, all of which exhibited thermal runaway regardless of thickness.

Figure 14:
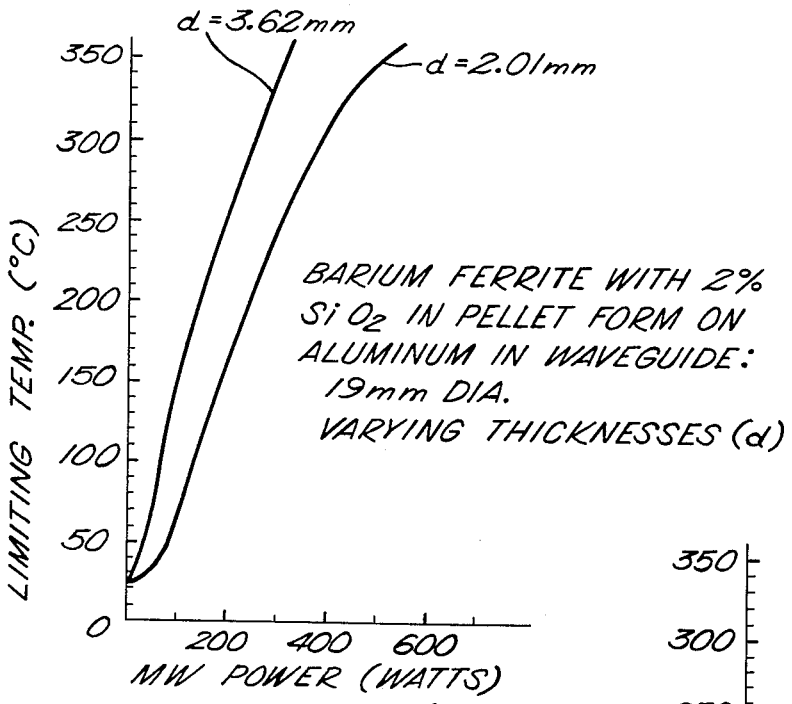
FIG. 14 is a graph illustrating functional relationships between material temperature and microwave power for barium ferrite at two different thicknesses.

FIG. 14 shows functional relationships between temperature and power for barium ferrite samples which had a resistance value of $10^6$ ohm cm and a Curie temperature of 465° C. Both samples did exhibit thermal runaway, although the graphs only go to 350° C. which is below the Curie temperature.

Figure 15:
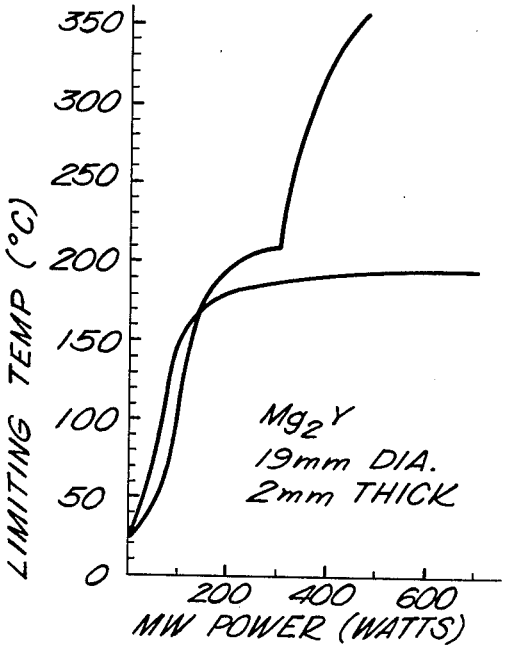
FIG. 15 is a graph illustrating functional relationships between material temperature and microwave power for $Mg_2Y$ samples.

FIG. 15 shows functional relationships between temperature and power for an $Mg_2Y$ sample of a thickness of 2 mm. One sample exhibited a temperature limiting at about 200° C. while a second sample exhibited thermal runaway. Analysis of this second sample has indicated that the thermal runaway was probably caused by barium ferrite impurities in the $Mg_2Y$ sample.

Figure 16:
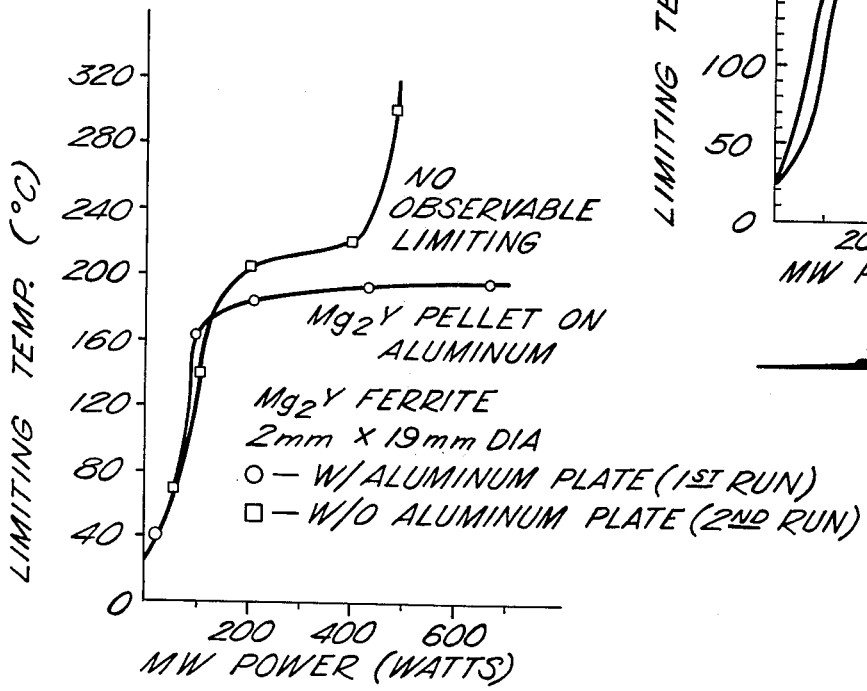
FIG. 16 is a graph illustrating the difference in heating characteristics of a sample heated with and without the use of a reflective member.
Figure 19:
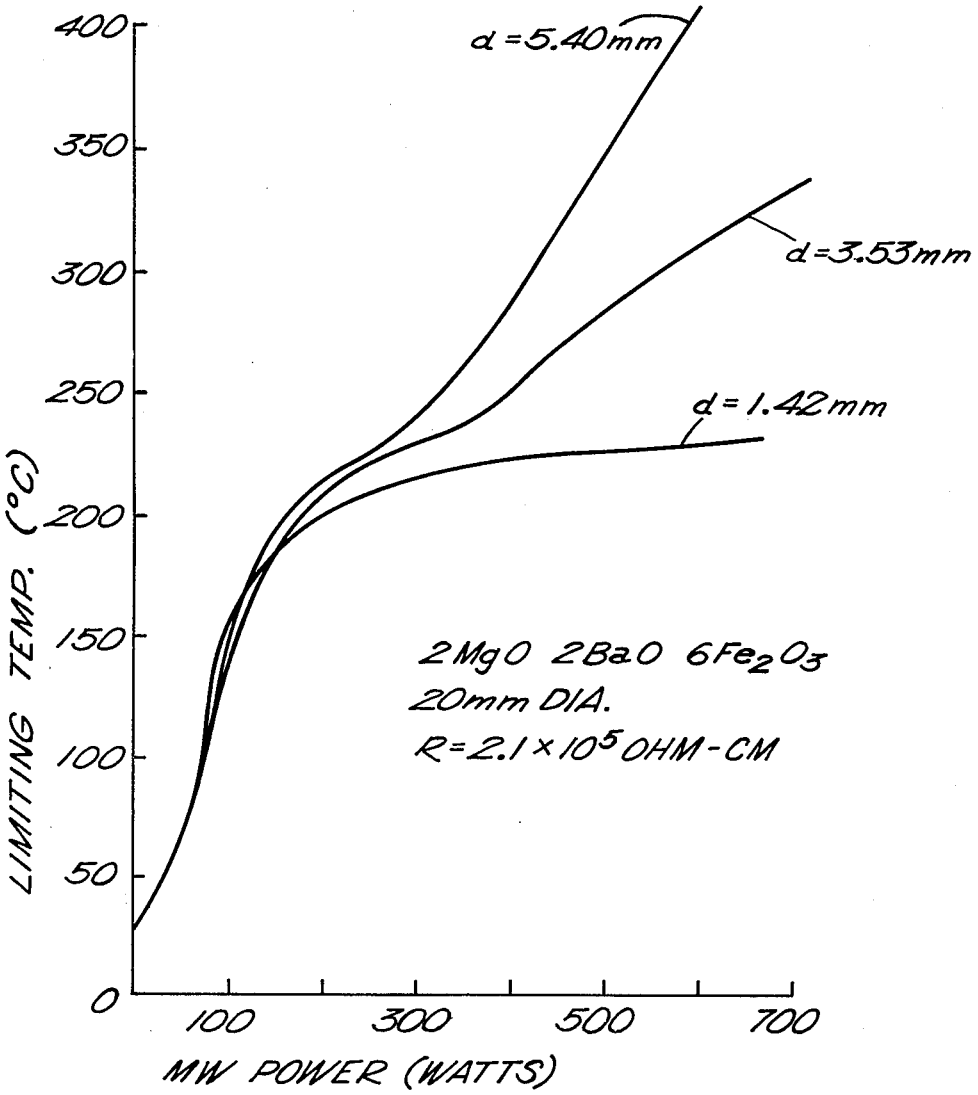
FIG. 19 is a graph illustrating functional relationships between material temperature and microwave power MgO 2BaO $6Fe_2O_3$ at three different thicknesses.

FIG. 16 shows functional relationships between temperature and power for a $Mg_2Y$ sample of a thickness of 2 mm and resistivity of $4\times10^5$ ohm cm. The line which shows thermal runaway was heated in the absence of a metal plate which would create the standing wave. The line which shows temperature limiting was with the sample being heated while in engagement with the metal plate. Thus, the importance of the use of the microwave reflective member is illustrated.

From the above graphs, it can be readily seen that by the appropriate selection of material parameters, i.e., Curie temperature and resistance and by the appropriate selection of d or d/λ that a microwave absorbing heater can be provided which exhibits an upper temperature limit for operation irrespective of the power applied. By appropriate selection of the Curie temperature by virtue of controlling the composition and properties of the absorbing material and by the addition of temperature modifying agents, the limiting temperature of such heaters can be predetermined.

What is meant by temperature self limiting is that when the temperature approaches the Curie temperature, a further increase in power will not result in a substantial increase in temperature. In other words, the temperature has become substantially independent of power. This is believed to be due to the fact that the absorbing material loses its magnetic properties at about the Curie temperature and thus the absorbing material is for all practical purposes no longer effected by the magnetic field portion of the microwave radiation.

It is to be understood that while there has been illustrated and described certain forms of the present invention, the invention is not to be limited to the specific form or arrangement of parts herein described and shown except to the extent that such limitations are found in the claims.

What is claimed is:

1. A device for use in a microwave radiation environment which device will absorb microwave radiation to produce heat and elevate the temperature of the device, said device including:

a microwave reflective member; and a lossy magnetic ferrite containing material of a type having a Curie temperature, said ferrite being in heat transfer relationship with a surface of said member with said ferrite containing material having thickness (d) in a direction generally normal to said surface such that at the Curie temperature the ferrite containing material will reflect at least about 65% of the impinging microwave radiation in the frequency range of about 300 MHZ to about $10^5$ MHZ, said ferrite containing material having a volume resistivity (R) in ohm cm of greater than about a value where Log R=(Tc/100)+2 (where Tc=the Curie temperature in °C. of the ferrite material) at room temperature.

2. A device as set forth in claim 1 wherein said ferrite containing material has a volume resistivity, at room temperature, in ohm cm of greater than about a value where Log R=(Tc/100)+2.5.

3. A device as set forth in claim 2 wherein said ferrite containing material has a volume resistivity, at room temperature, in ohm cm of greater than about a value where Log R=(Tc/100)+3.

4. A device as set forth in claim 1 wherein said thickness is such that d/λ is less than about 0.25 (where λ is the wavelength of the microwave radiation in the material as measured at the Curie temperature of the material).

5. A device as set forth in claim 4 wherein said thickness is such that d/λ is less than about 0.16.

6. A device as set forth in claim 5 wherein said thickness is such that d/λ is in the range of between about 0.02 and 0.16.

7. A device as set forth in claim 1 wherein said thickness is less than about 7.3 mm.

8. A device as set forth in claim 7 wherein said thickness is less than about 4.7 mm.

9. A device as set forth in claim 8 wherein the thickness is in the range of between about 4.7 mm and 0.6 mm.

10. A device as set forth in claims 1, 2, 3, 4, 5, 6, 7, 8 or 9 wherein said member is metallic.

11. A device as set forth in claim 10 wherein said member is generally planar and said surface is a main generally planar surface of said member.

12. A device as set forth in claim 10 wherein said ferrite is of a hexagonal crystal structure.

13. A device as set forth in claim 12 wherein said ferrite is selected from hexagonal ferrite compositions containing $Fe_2O_3$, BaO and a divalent metal oxide.

14. A device as set forth in claim 10 wherein said ferrite is bonded to said reflective member.

15. A device as set forth in claim 10 wherein said ferrite is a continuous layer.

16. A device as set forth in claim 10 wherein said ferrite is in the form of a plurality of pellets in spaced-apart relation.

17. A device as set forth in claim 10, including a package substantially enclosing said device, said package being defined by a plurality of walls.

18. A device as set forth in claim 12 including a package substantially enclosing said device, said package being defined by a plurality of walls.

19. A device as set forth in claim 13 including a package substantially enclosing said device defined by a plurality of walls.

20. A device as set forth in claim 17 wherein a first wall of said package is in supporting engagement with said device and is microwave transparent or opaque.

21. A device as set forth in claim 18 wherein a first wall of said package is in supporting engagement with said device and is microwave transparent or opaque.

22. A device as set forth in claim 19 wherein a first wall of said package is in supporting engagement with said device and is microwave transparent or opaque.

23. A device as set forth in claim 20 wherein at least one other of said walls is shielded to at least partially restrict entry of microwave radiation into the package.

24. A device as set forth in claim 21 wherein at least one other of said walls is shielded to at least partially restrict entry of microwave radiation into the package.

25. A device as set forth in claims 1, 2, 3, 4, 5 or 6 wherein the microwave frequency is about 915 MHZ.

26. A device as set forth in claims 1, 2, 3, 4, 5 or 6 wherein the microwave frequency is about 5800 MHZ.

27. A device as set forth in claims 1, 2, 3, 4, 5, 6, 7, 8, or 9 wherein the microwave frequency is about 2450 MHZ.

28. A device as set forth in claims 1, 2, 3, 4, 5 or 6 wherein the microwave frequency is about 22,125 MHZ.

29. A device as set forth in claims 1, 2, 3, 4, 5, 6, 7, 8, or 9 wherein the ferrite material comprises $Mg_2 Ba_2 Fe_{12} O_{22}$.

30. A device as set forth in claim 27 wherein the ferrite material comprises $Mg_2 Ba_2 Fe_{12} O_{22}$.

31. A device as set forth in claim 10 including a non-disposable heating utensil adapted for repetitive heating cycles and adapted to contain a product to be heated with said utensil being associated with said device in a manner whereby the product would be in heat transfer relation with the ferrite material.

32. A device as set forth in claim 10 wherein said ferrite containing material includes a temperature modifying agent which is operable for changing the Curie temperature of the ferrite containing material from the Curie temperature without the temperature modifying agent.

33. A device as set forth in claim 10 wherein the Curie temperature is in the range of between about 0° C. and about 500° C.

34. A device as set forth in claim 33 wherein the Curie temperature is in the range of between about 100° C. and about 400° C.

35. A device as set forth in claim 10 wherein said ferrite containing material is in the form of a plurality of pellets each in heat transfer relation to the reflective member, at least one portion of the pellets has a Curie temperature different from the Curie temperature of the remainder of the pellets and being distributed relative to the remainder of the pellets to provide plural zone temperatures on the reflective member.

36. A device as set forth in claim 10 wherein the ferrite containing material is in the form of a substantially continuous sheet with the thickness of the sheet varying from area to area.

37. A device as set forth in claim 10 wherein the ferrite containing material is in a plurality of layers with at least one layer having a different composition than another one of the layers.

38. A device as set forth in claims 2 or 3 wherein the thickness is such that $d/\lambda$ is less than about 0.25 (where $\lambda$ is the wavelength of the microwave radiation in the material as measured at the Curie temperature of the material).

39. A device as set forth in claim 38 wherein the thickness is such that $d/\lambda$ is less than about 0.16.

40. A device as set forth in claim 39 wherein the thickness is such that $d/\lambda$ is in the range of between about 0.02 and 0.16.

41. A device as set forth in claim 27 wherein the Curie temperature is in the range of between about 0° C. and about 500° C.

42. A device as set forth in claim 41 wherein the Curie temperature is in the range of between about 100° C. and about 400° C.

43. A method of converting microwave radiation to heat placing a microwave reflective member into an area to be irradiated with microwave radiation;

placing a lossy magnetic ferrite containing material of a type having a Curie temperature, said ferrite being in heat transfer relationship with a surface of said member with said ferrite containing material having thickness (d) in a direction generally normal to said surface such that at the Curie temperature the ferrite containing material will reflect at least about 65% of the impinging microwave radiation in the frequency range of about 300 MHZ to about $10^5$ MHZ, said ferrite containing material having a volume resistivity (R) in ohm cm of greater than about a value where $\text{Log } R=(Tc/100)+2$ (where Tc=the Curie temperature in °C. of the ferrite material) at room temperature; and irradiating said member and said ferrite containing material with microwave radiation thereby causing said ferrite containing material to convert microwave radiation to heat and thereby heat said member.

44. A method as set forth in claim 43 wherein said ferrite containing material has a volume resistivity, at room temperature, in ohm cm of greater than about a value where $\text{Log } R=Tc+2.5$.

45. A method as set forth in claim 44 wherein said ferrite containing material has a volume resistivity, at room temperature, in ohm cm of greater than about a value where $\text{Log } R=Tc+3$.

46. A method as set forth in claim 43 wherein said thickness is such that $d/\lambda$ is less than about 0.25 (where $\lambda$ is the wavelength of the microwave radiation in the material as measured at the Curie temperature of the material).

47. A method as set forth in claim 46 wherein said thickness is such that $d/\lambda$ is less than about 0.16.

48. A method as set forth in claim 47 wherein said thickness is such that $d/\lambda$ is in the range of between about 0.02 and 0.16.

49. A method as set forth in claims 43, 44, 45, 46, 47 or 48, including placing a food product in heat transfer relation with the member and thereafter subjecting the member and ferrite containing material to microwave radiation.

50. A method as set forth in claim 49, including subjecting said food product to microwave radiation during the subjecting of the member and ferrite containing material to microwave radiation.

* * * * *